US006255027B1

(12) United States Patent
Wehelie et al.

(10) Patent No.: US 6,255,027 B1
(45) Date of Patent: Jul. 3, 2001

(54) BLOCKING LAYER WITH LIGHT SCATTERING PARTICLES HAVING COATED CORE

(75) Inventors: Abukar H. Wehelie, Webster; John S. Chambers, Rochester; Huoy-Jen Yuh, Pittsford; Harold F. Hammond, Webster, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/575,761

(22) Filed: May 22, 2000

(51) Int. Cl.[7] ..... G03G 15/04
(52) U.S. Cl. ..... 430/65; 430/64
(58) Field of Search ..... 430/64, 65

(56) References Cited

U.S. PATENT DOCUMENTS 4,948,690 * 8/1990 Hisamura et al. ..... 430/64
5,190,837 * 3/1993 Sakai et al. ..... 430/65
5,215,839 6/1993 Yu ..... 430/58
5,391,448 * 2/1995 Katayama et al. ..... 430/65
5,660,961 8/1997 Yu ..... 430/58
5,958,638 9/1999 Katayama et al. ..... 430/65
6,156,468 12/2000 Wehelie et al. ..... 430/65

* cited by examiner

*Primary Examiner*—Mark Chapman
(74) *Attorney, Agent, or Firm*—Zosan S. Soong

(57) ABSTRACT

A photoreceptor including: (a) a substrate; (b) a charge blocking layer including a plurality of light scattering particles dispersed in a binder, wherein the light scattering particles are composed of a core and a coating over the core, wherein the difference between the coating and the binder refractive index values is greater than the difference between the core and the binder refractive index values; and (c) an imaging layer.

16 Claims, 3 Drawing Sheets

BLOCKING LAYER WITH LIGHT SCATTERING PARTICLES HAVING COATED CORE

FIELD OF THE INVENTION

This invention relates to a photoreceptor useful for an electrostatographic printing machine, and particularly to an improved charge blocking layer.

BACKGROUND OF THE INVENTION

Coherent illumination is used in electrophotographic printing for image formation on photoreceptors. Unfortunately, the use of coherent illumination sources in conjunction with multilayered photoreceptors results in a print quality defect known as the "plywood effect" or the "interference fringe effect." This defect consists of a series of dark and light interference patterns that occur when the coherent light is reflected from the interfaces that pervade multilayered photoreceptors. In organic photoreceptors, primarily the reflection from the air/charge transport layer interface (i.e., top surface) and the reflection from the undercoat layer or charge blocking layer/substrate interface (i.e., substrate surface) account for the interference fringe effect. The effect can be eliminated if the strong charge transport layer surface reflection or the strong substrate surface reflection is eliminated or suppressed.

Methods have been proposed to suppress the air/charge transport layer interface specular reflection, including roughening of the charge transport layer surface by introducing micrometer size $SiO_2$ dispersion and other particles into the charge transport layer, applying an appropriate overcoating layer and the like.

Methods have also been proposed to suppress the intensity of substrate surface specular reflection, e.g., coating specific materials such as anti-reflection materials and light scattering materials on the substrate surface and roughening methods such as dry blasting and liquid honing of the substrate surface. For example, photoreceptor substrate surfaces have been roughened by propelling ceramic and glass particles against a surface.

Conventional photoreceptors are disclosed in the following patents, a number of which describe the presence of light scattering particles in the charge blocking layer: Yu, U.S. Pat. No. 5,660,961; Yu, U.S. Pat. No. 5,215,839; and Katayama et al., U.S. Pat. No. 5,958,638.

A problem with conventional charge blocking layers employing light scattering particles is that the range of suitable materials for the light scattering particles is somewhat limited. Many polymeric materials have the particle size, density, and dispersion stability in the proper range, but they have refractive index values that are too close to the binder resin used in the charge blocking layer. Light scattering particles having a refractive index similar to the binder refractive index may produce light scattering insufficient to eliminate the plywood effect in the resulting prints. Selecting inorganic particles such as metal oxides, which typically may have a higher refractive index than polymeric materials, to be the light scattering particles is problematic. This is because inorganic particles such as the metal oxides generally may have higher densities than polymeric materials which can create a particle settling problem that adversely affects the uniformity of the blocking layer and the quality of the resulting prints. Thus, there is a need for an improved charge blocking which avoids or minimizes the problems discussed above.

The phrases "charge blocking layer" and "blocking layer" are generally used interchangeably with the phrase "undercoat layer."

SUMMARY OF THE INVENTION

The present invention is accomplished in embodiments by providing a photoreceptor comprising:

(a) a substrate;

(b) a charge blocking layer including a plurality of light scattering particles dispersed in a binder, wherein the light scattering particles are comprised of a core and a coating over the core, wherein the difference between the coating and the binder refractive index values is greater than the difference between the core and the binder refractive index values; and (c) an imaging layer.

BRIEF DESCRIPTION OF THE DRAWINGS

Other aspects of the present invention will become apparent as the following description proceeds and upon reference to the Figures which represent preferred embodiments.

Unless otherwise noted, the same reference numeral in different Figures refers to the same or similar feature.

DETAILED DESCRIPTION

Figure 1:
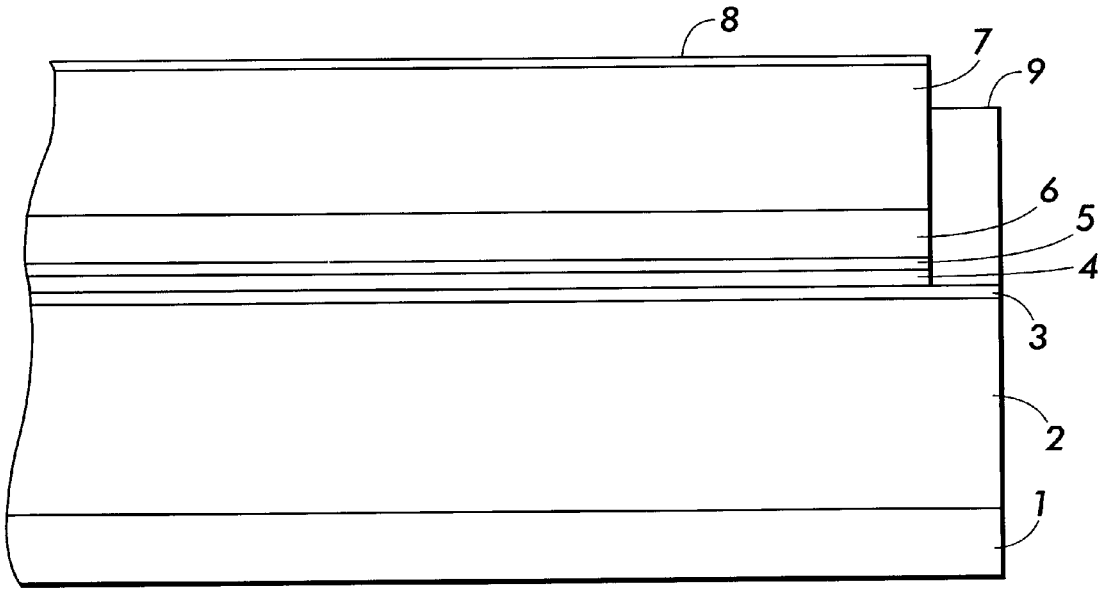
FIG. 1 represents a simplified side view of a first embodiment of the inventive photoreceptor.
Figure 2:
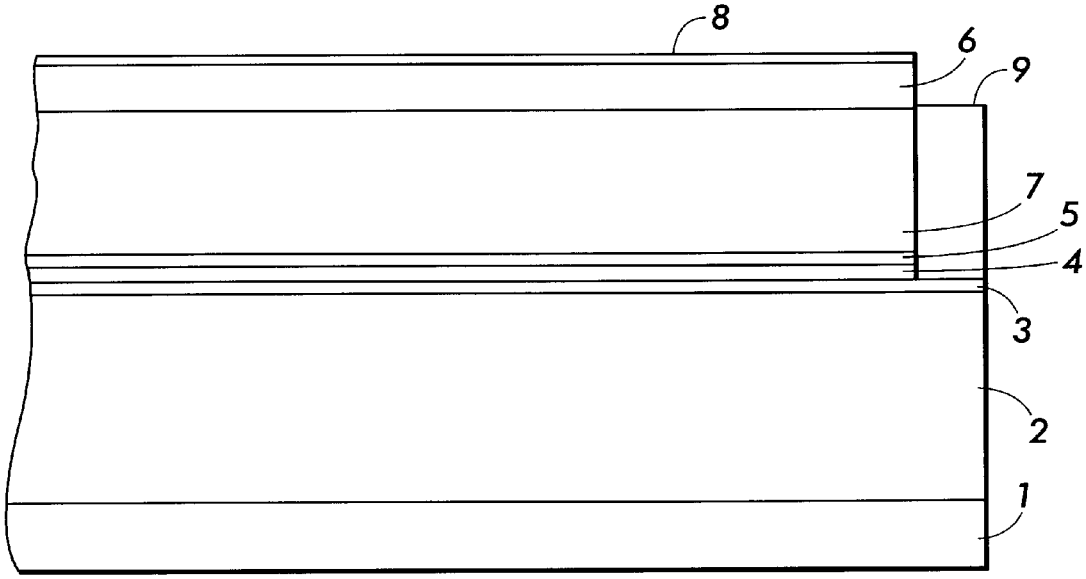
FIG. 2 represents a simplified side view of a second embodiment of the inventive photoreceptor.
Figure 3:
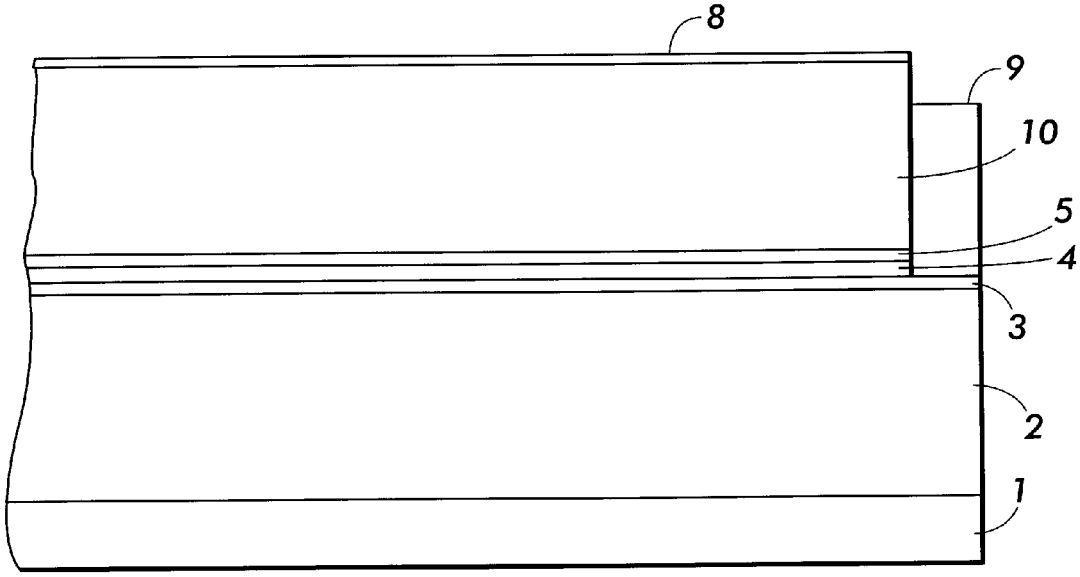
FIG. 3 represents a simplified side view of a third embodiment of the inventive photoreceptor.

Representative structures of an electrophotographic imaging member (e.g., a photoreceptor) are shown in FIGS. 1–3. These imaging members are provided with an anti-curl layer 1, a supporting substrate 2, an electrically conductive ground plane 3, a charge blocking layer 4, an adhesive layer 5, a charge generating layer 6, a charge transport layer 7, an overcoating layer 8, and a ground strip 9. In FIG. 3, imaging layer 10 (containing both charge generating material and charge transport material) takes the place of separate charge generating layer 6 and charge transport layer 7.

As seen in the figures, in fabricating a photoreceptor, a charge generating material (CGM) and a charge transport material (CTM) may be deposited onto the substrate surface either in a laminate type configuration where the CGM and CTM are in different layers (e.g., FIGS. 1 and 2) or in a single layer configuration where the CGM and CTM are in the same layer (e.g., FIG. 3) along with a binder resin. The photoreceptors embodying the present invention can be prepared by applying over the electrically conductive layer the charge generation layer 6 and, optionally, a charge transport layer 7. In embodiments, the charge generation layer and, when present, the charge transport layer, may be applied in either order.

The Anti-Curl Layer

For some applications, an optional anti-curl layer 1 can be provided, which comprises film-forming organic or inorganic polymers that are electrically insulating or slightly semi-conductive. The anti-curl layer provides flatness and/or abrasion resistance.

Anti-curl layer 1 can be formed at the back side of the substrate 2, opposite the imaging layers. The anti-curl layer may include, in addition to the film-forming resin, an adhesion promoter polyester additive. Examples of film-forming resins useful as the anti-curl layer include, but are not limited to, polyacrylate, polystyrene, poly(4,4'-isopropylidene diphenylcarbonate), poly(4,4'-cyclohexylidene diphenylcarbonate), mixtures thereof and the like.

Additives may be present in the anti-curl layer in the range of about 0.5 to about 40 weight percent of the anti-curl layer. Preferred additives include organic and inorganic particles which can further improve the wear resistance and/or provide charge relaxation property. Preferred organic particles include Teflon powder, carbon black, and graphite particles. Preferred inorganic particles include insulating and semiconducting metal oxide particles such as silica, zinc oxide, tin oxide and the like. Another semiconducting additive is the oxidized oligomer salts as described in U.S. Pat. No. 5,853,906. The preferred oligomer salts are oxidized N, N, N', N'-tetra-p-tolyl-4,4'-biphenyldiamine salt.

Typical adhesion promoters useful as additives include, but are not limited to, duPont 49,000 (duPont), Vitel PE-100, Vitel PE-200, Vitel PE-307 (Goodyear), mixtures thereof and the like. Usually from about 1 to about 15 weight percent adhesion promoter is selected for film-forming resin addition, based on the weight of the film-forming resin.

The thickness of the anti-curl layer is typically from about 3 micrometers to about 35 micrometers and, preferably, about 14 micrometers. However, thicknesses outside these ranges can be used.

The anti-curl coating can be applied as a solution prepared by dissolving the film-forming resin and the adhesion promoter in a solvent such as methylene chloride. The solution may be applied to the rear surface of the supporting substrate (the side opposite the imaging layers) of the photoreceptor device, for example, by web coating or by other methods known in the art. Coating of the overcoat layer and the anti-curl layer can be accomplished simultaneously by web coating onto a multilayer photoreceptor comprising a charge transport layer, charge generation layer, adhesive layer, blocking layer, ground plane and substrate. The wet film coating is then dried to produce the anti-curl layer 1.

The Supporting Substrate

As indicated above, the photoreceptors are prepared by first providing a substrate 2, i.e., a support. The substrate can be opaque or substantially transparent and can comprise any of numerous suitable materials having given required mechanical properties.

The substrate can comprise a layer of electrically non-conductive material or a layer of electrically conductive material, such as an inorganic or organic composition. If a non-conductive material is employed, it is necessary to provide an electrically conductive ground plane over such non-conductive material. If a conductive material is used as the substrate, a separate ground plane layer may not be necessary.

The substrate can be flexible or rigid and can have any of a number of different configurations, such as, for example, a sheet, a scroll, an endless flexible belt, a web, a cylinder, and the like. The photoreceptor may be coated on a rigid, opaque, conducting substrate, such as an aluminum drum.

Various resins can be used as electrically non-conducting materials, including, but not limited to, polyesters, polycarbonates, polyamides, polyurethanes, and the like. Such a substrate preferably comprises a commercially available biaxially oriented polyester known as MYLAR™, available from E. I. duPont de Nemours & Co., MELINEX™, available from ICI Americas Inc., or HOSTAPHAN™, available from American Hoechst Corporation. Other materials of which the substrate may be comprised include polymeric materials, such as polyvinyl fluoride, available as TEDLAR™ from E. I. duPont de Nemours & Co., polyethylene and polypropylene, available as MARLEX™ from Phillips Petroleum Company, polyphenylene sulfide, RYTON™ available from Phillips Petroleum Company, and polyimides, available as KAPTON™ from E. I. duPont de Nemours & Co. The photoreceptor can also be coated on an insulating plastic drum, provided a conducting ground plane has previously been coated on its surface, as described above. Such substrates can either be seamed or seamless.

When a conductive substrate is employed, any suitable conductive material can be used. For example, the conductive material can include, but is not limited to, metal flakes, powders or fibers, such as aluminum, titanium, nickel, chromium, brass, gold, stainless steel, carbon black, graphite, or the like, in a binder resin including metal oxides, sulfides, silicides, quaternary ammonium salt compositions, conductive polymers such as polyacetylene or its pyrolysis and molecular doped products, charge 1 transfer complexes, and polyphenyl silane and molecular doped products from polyphenyl silane. A conducting plastic drum can be used, as well as the preferred conducting metal drum made from a material such as aluminum.

The preferred thickness of the substrate depends on numerous factors, including the required mechanical performance and economic considerations. The thickness of the substrate is typically within a range of from about 65 micrometers to about 150 micrometers, and preferably is from about 75 micrometers to about 125 micrometers for optimum flexibility and minimum induced surface bending stress when cycled around small diameter rollers, e.g., 19 mm diameter rollers. The substrate for a flexible belt can be of substantial thickness, for example, over 200 micrometers, or of minimum thickness, for example, less than 50 micrometers, provided there are no adverse effects on the final photoconductive device. Where a drum is used, the thickness should be sufficient to provide the necessary rigidity. This is usually about 1–6 mm.

The surface of the substrate to which a layer is to be applied is preferably cleaned to promote greater adhesion of such a layer. Cleaning can be effected, for example, by exposing the surface of the substrate layer to plasma discharge, ion bombardment, and the like. Other methods, such as solvent cleaning, can be used.

Regardless of any technique employed to form a metal layer, a thin layer of metal oxide generally forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer.

The Electrically Conductive Ground Plane

As stated above, photoreceptors prepared in accordance with the present invention comprise a substrate that is either electrically conductive or electrically non-conductive. When a non-conductive substrate is employed, an electrically conductive ground plane 3 must be employed, and the ground plane acts as the conductive layer. When a conductive substrate is employed, the substrate can act as the conductive layer, although a conductive ground plane may also be provided.

If an electrically conductive ground plane is used, it is positioned over the substrate. Suitable materials for the electrically conductive ground plane include, but are not limited to, aluminum, zirconium, niobium, tantalum, vanadium, hafnium, titanium, nickel, stainless steel, chromium, tungsten, molybdenum, copper, and the like, and mixtures and alloys thereof. In embodiments, aluminum, titanium, and zirconium are preferred.

The ground plane can be applied by known coating techniques, such as solution coating, vapor deposition, and sputtering. A preferred method of applying an electrically conductive ground plane is by vacuum deposition. Other suitable methods can also be used.

Preferred thicknesses of the ground plane are within a substantially wide range, depending on the optical transparency and flexibility desired for the electrophotoconductive member. Accordingly, for a flexible photoresponsive imaging device, the thickness of the conductive layer is preferably between about 20 angstroms and about 750 angstroms; more preferably, from about 50 angstroms to about 200 angstroms for an optimum combination of electrical conductivity, flexibility, and light transmission. However, the ground plane can, if desired, be opaque.

The Charge Blocking Layer

After deposition of any electrically conductive ground plane layer, a charge blocking layer 4 can be applied thereto. Electron blocking layers for positively charged photoreceptors permit holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer can be utilized.

A blocking layer is preferably positioned over the electrically conductive layer. The term "over," as used herein in connection with many different types of layers, should be understood as not being limited to instances wherein the layers are contiguous. Rather, the term refers to relative placement of the layers and encompasses the inclusion of unspecified intermediate layers.

The blocking layer 4 includes light scattering particles and a binder, wherein the light scattering particles are composed of a core overcoated with a coating. The core is preferably low density such as an organic material (especially polymeric materials) or an inorganic materials except for metal containing compounds like metal oxides. The core may have a density ranging for example from about 0.5 to about 2.0 g/cc, preferably from about 1.0 to about 1.5 g/cc. In embodiments of the present invention, higher density materials, higher than the specific ranges recited herein, may be used for the core even including for example metal containing compounds like metal oxides. Thus in embodiments of the present invention, any organic material and inorganic material regardless of density may be used for the core including any of the materials described herein for the coating.

Organic materials suitable for the core include for example polymethacrylate such as polymethylmethacrylate, polyacrylate, polyurethane, nylon such as nylon 6, silicone, and phenolic resin.

Inorganic materials suitable for the core include for example silica, aluminum oxide, metal sulfide such as lithium sulfide, silica sulfide, and metal carbide such as lithium carbide. A preferred inorganic material for the core is silica. Synthetic silica includes precipitated silica, pyrogenic silica, aerogels and hydrogels. These types of silica have refractive index values of about 1.42.

The coating of the light scattering particles may be any material wherein the difference between the coating and the binder refractive index values is greater than the difference between the core and the binder refractive index values. Preferred materials for the coating are inorganic materials such as amorphous silica and minerals. Typical minerals include, for example, oxides including metal oxides, silicates, carbonates, sulfates, sulfites, iodites, hydroxides, chlorides, fluorides, phosphates, chromates, chromites, clay, sulfur, and the like. The expression "mineral", as employed herein, is defined as the inorganic constituents of the earth's crust including naturally ocurring elements, compounds and mixtures having a definite range of chemical composition and properties or the synthesized versions thereof. The minerals may have chemically reactive groups capable of reacting with reactive groups on the core and/or binder. Typical chemically reactive groups on the minerals include, for example, hydroxides, oxides, silanols and the like.

The light scattering particles of the present invention preferably should have the capability of substantially scattering all the incident radiation, having a wavelength between about 400 and about 950 nm, in order to eliminate the interference fringes. In other words, specific light scattering particles or mixtures thereof selected for any given blocking layer dispersion should be able to suppress or eliminate substantially all of the activating radiation frequencies to which the charge generator layer employed is exposed.

The solid light scattering particles preferably should have an average particle size substantially smaller than the thickness of the dried charge blocking layer to avoid particle protrusion. The light scattering particles may have an average particle size ranging for example from about 0.2 micrometer to about 2.5 micrometers, and preferably from about 0.4 micrometer to about 1.5 micrometer. In embodiments, the light scattering particles may have an average particle size ranging from about 0.5 micrometer to about 1 micrometer (about half of the wavelength of the irradiating light beam) for greater light scattering effectiveness.

The core of the light scattering particles may have any suitable shape including for example spherical, generally spherical, or irregularly shaped. The core may have an average particle size ranging for example from about 0.2 micrometer to about 2.5 micrometers, and preferably from about 0.4 micrometer to about 1.5 micrometer.

The coating of the light scattering particles preferably has a refractive index significantly different from that of the binder which typically has a refractive index ranging from about 1.54 to about 1.60. A refractive index difference between the coating of the light scattering particles and the binder of between about 0.08 and about 1.5, more preferably, between about 0.1 and about 1.0, is preferred to effect satisfactory light scattering results. Optimum results may be achieved with a refractive index difference between the coating of the light scattering particles and the binder ranging from about 0.15 to about 0.8.

The selection of the coating (of the light scattering particles) having a refractive index significantly different from the refractive index of the binder is important to the achieving of adequate light scattering and the elimination of plywood fringes. Suitable materials for the coating having a refractive index significantly different from the typical 1.54 to 1.60 refractive index value of the binder, include, for example, synthetic amorphous silica such as fumed silica, precipitated silica, and silica gels. Other minerals of equal interest may also include, aluminum oxide (Corundum), antimony oxide (Senarmontite, Valentinite), arsenic oxide (Arsenolite, Claudetite), iron oxide (Hematite, Magnetite), lead oxide (Litharge, Minium), magnesium oxide (Periclas), manganese oxide (Hausmannite, Manganosite, Pyrolusite), nickel oxide (Bunsenite), tin oxide (Cassiterite), titanium oxide (Brookite), zinc oxide (Zincite), zirconium oxide (Baddeleyite), barium sulfate (Barite), lead sulfate (Anglesite), potassium sulfate (Arcanite), sodium sulfate (Themadite), antimony sulfite (Stibnite), arsenic sulfide (Orpiment, Realgar), cadmium sulfide (Greenockite), calcium sulfide (Oldhamite), iron sulfide (Mrcasite, Pyrite, Pyrrhotite), lead sulfide (Galena), zinc sulfide (Sphalerite, Wurtzite), barium carbonate (Witherite), iron carbonate (Siderite), lead carbonate (Cerussite), magnesium carbonate (Magnesite), manganese carbonate (Rhodochrosite), sodium carbonate (Thermonatrite), zinc carbonate (Smithsonite), aluminum hydroxide (Boehmite, Diaspore, Gibbsite), iron hydroxide (Goethite, Lepidocrocite), manganese hydroxide (Pydrochroite), copper chloride (Nantokite), lead chloride (Cotunnite), silver chloride (Cerargyrite), silver iodide (Jodyrite, Miersite), lead chromate (Crocoite), beryllium silicate (Phenakite), sodium aluminosilicate (Natrolite, Mesolite, Scolecite, Thomasonite), zirconium silicate (Zircon), as well as acmite (Aegirine), brimstone (Sulfur), carborundum (Moissanite), chromspinel (Chromite), epsomsalt (Epsomite), garnet (Almandine, Pyrope, Spessartite), indocrase (Vesuvianite), iron spinel (Hercynite), lithiophyllite (Triphylite), orthite (Allanite), peridote (Olivine), pistacite (Epidote), titanite (Sphene), zinc sulfate, and the like. Preferred metal oxides for the coating include titanium dioxide and zinc oxide (i.e., ZnO).

In the light scattering particles, the coating may partially or totally cover the core. The coating may be uniform or non-uniform in thickness. The coating may have a thickness ranging from about 10 angstroms to about 3 micrometers, preferably from about 100 angstroms to about 1 micrometer. The light scattering particles all may be the same or a mixture of different particle sizes, different combinations of materials for the core and coating, and the like. In addition, the light scattering particles may be a mixture where in some particles the coating partially overcoats the core and in other particles the coating totally overcoats the core. The coating of the light scattering materials can be accomplished by dispersing the core particles in a solution containing the salt of the light scattering materials. The salt of the light scattering materials can then deposit onto the core particle surface through a reaction, such as oxidation, reduction or condensation. The solvents can then be removed and the particles cleaned to remove the residual salts. The coated particles can be further heated to reduce the coatings to oxides. One example given in U.S. Pat. No. 4,579,801, the disclosure of which is hereby totally incorporated herein by reference, is to surface coat the titanium oxide with alumina. The titanium oxide powder is dispersed in an aqueous solution of aluminum salt. Then alkali agent is added into the dispersion to deposit aluminum hydroxide on the titanium oxide surface. The filtered powder is then heated at high temperature to convert the aluminum hydroxide to alumina. The coverage of the coating and the thickness of the coating can be controlled by the duration of the particles in the salt solution. The longer the duation, the thicker the coating and the more complete the coverage is.

The extent of differences among the refractive index values of the core, the coating, and the binder is important in the present invention. The difference between the core and the binder refractive index values may range for example from 0 to about 0.07, and more preferably from 0 to about 0.05. The difference between the coating and the binder refractive index values may be for example at least about 0.08, preferably at least about 1.0, more preferably from about 0.08 to about 1.5, especially from about 0.1 to about 1.0, and optimally from about 0.15 to about 0.8. The difference between the coating and the binder refractive index values may be greater than the difference between the core and the binder refractive index values by for example at least about 0.05, preferably at least about 1.0, and more preferably from about 1.0 to about 2.0. Unless otherwise indicated, the magnitude of the difference between the refractive index values of two materials being compared is important, not that one material has a higher (or lower) refractive index value than the other material.

The refractive index values are determined by referring to reference publications such as the *CRC Handbook of Chemistry and Physics,* the disclosure of which is totally incorporated herein by reference, and looking up the recited values for the materials of the core, coating, and binder. If the refractive index value for a particular material is not listed in any reference publication, then the material's refractive index value may be determined by a known standard method.

Generally, the amount of light scattering particles utilized in the charge blocking layer depends upon the average size of the particles, the degree of mismatch between the refractive index of dispersed particles and the refractive index of the binder of the blocking layer, and the thickness of the dried and crosslinked blocking layer. Sufficent light scattering particles should be present to effectively scatter the radiation energy which reaches the blocking layer so that substantially no incident radiation is reflected back into the overlying layers. The light scattering particles may be present in the charge blocking layer in an amount ranging from about 2% to about 60% by weight, and preferably from about 5% to about 30% by weight, based on the weight of the blocking layer.

Suitable materials for the binder include polymers such as polyvinyl butyral, epoxy resins, polyesters, phenolic resins, polysiloxanes, polyamides, polyurethanes, and the like; nitrogen-containing siloxanes or nitrogen-containing titanium compounds, such as trimethoxysilyl propyl ethylene diamine, N-beta(aminoethyl) gamma-aminopropyl trimethoxy silane, isopropyl 4-aminobenzene sulfonyl titanate, di(dodecylbenezene sulfonyl) titanate, isopropyl di(4-aminobenzoyl)isostearoyl titanate, isopropyl tri(N-ethyl amino) titanate, isopropyl trianthranil titanate, isopropyl tri(N,N-dimethyl-ethyl amino) titanate, titanium-4-amino benzene sulfonate oxyacetate, titanium 4-aminobenzoate isostearate oxyacetate, gamma-aminobutyl methyl dimethoxy silane, gamma-aminopropyl methyl dimethoxy silane, and gamma-aminopropyl trimethoxy silane, as disclosed in U.S. Pat. Nos. 4,338,387, 4,286,033, and 4,291,110. The binder may be linear phenolic binder compositions including DURITE® P97 and DURITE® ESD-556C (both available from Borden Chemical) and a non-linear phenolic binder composition, VARCUM® 29108 (available from OxyChem). The binder may be present in an amount ranging from about 10% to about 80% by weight based on the weight of the dried blocking layer.

The charge blocking layer may optionally contain other ingredients including for example electron transporting materials such as diphenoquinones and n-type particles like titanium dioxide, and hole blocking materials such as polyvinyl pyridine. These optional ingredients may be present in an amount ranging for example from 0 to about 80% by weight based on the weight of the blocking layer.

The blocking layer 4 should be continuous and can have a thickness ranging for example from about 0.01 to about 10 micrometers, preferably from about 0.05 to about 5 micrometers.

The blocking layer 4 can be applied by any suitable technique, such as spraying, dip coating, draw bar coating, gravure coating, silk screening, air knife coating, reverse roll coating, vacuum deposition, chemical treatment, and the like. For convenience in obtaining thin layers, the blocking layer is preferably applied in the form of a dilute solution, with the solvent being removed after deposition of the coating by conventional techniques, such as by vacuum, heating, and the like. Generally, a weight ratio of blocking layer material and solvent of between about 0.5:100 to about 30:100 is satisfactory for spray and dip coating.

The present invention further provides a method for forming the electrophotographic photoreceptor, in which the charge blocking layer is formed by using a coating solution composed of the light scattering particles, the binder resin and a solvent.

The solvent may be an organic solvent which can be a mixture of an azeotropic mixture of $C_{1-3}$ lower alcohol and another organic solvent selected from the group consisting of dichloromethane, chloroform, 1,2-dichloroethane, 1,2-dichloropropane, toluene and tetrahydrofuran. The azeotropic mixture mentioned above is a mixture solution in which a composition of the liquid phase and a composition of the vapor phase are coincided with each other at a certain pressure to give a mixture having a constant boiling point. For example, a mixture consisted of 35 parts by weight of methanol and 65 parts by weight of 1,2-dichloroethane is an azeotropic solution. The azeotropic composition leads to uniform evaporation, thereby forming a uniform charge blocking layer without coating defects and improving storage stability of the charge blocking coating solution.

The solvent may be a xylene and organic solvent mixture in a weight ratio ranging from about 80(xylene)/20(organic solvent) to about 20/80. The organic solvent may be an alcohol which is preferably a low alcohol solvent (that is, having from one to five carbon atoms) such as methanol, ethanol, butanol, or mixtures thereof. A mixture of xylene and a hydrocarbon organic solvent, such as toluene, can also be used.

The charge blocking layer is formed by dispersing the binder resin and the light scattering particles in the solvent to form a coating solution for the blocking layer; coating the conductive support with the coating solution and drying it. The solvent is selected for improving dispersion in the solvent and for preventing the coating solution from gelation with the elapse of time. Further, the solvent may be used for preventing the composition of the coating solution from being changed as time passes, whereby storage stability of the coating solution can be improved and the coating solution can be reproduced.

The solids content (i.e., all solids such as the binder and light scattering particles) of the charge blocking dispersion ranges for example from about 2% to about 50% by weight, based on the weight of the dispersion.

The solvent, or a mixture of two or more solvents, may be present in an amount ranging from about 50% to about 98% by weight, based on the weight of the charge blocking dispersion.

Suitable weight ratios of the components include the following: light scattering particles to binder ratio ranging for example from about 2 light scattering particles)/98 (binder) to about 60 (light scattering particles)/40 (binder), preferably from about 5/95 to about 40/60.

The present invention is advantageous because it allows a wider choice of materials for the light scattering particles. A low density core (having the density described herein) prevents or minimizes particle settling which is detrimental to the uniformity of the charge blocking layer and thus print quality. Since compared with the core, the coating generally contributes a minority of the mass for each light scattering particle, the coating can have a lower or higher density without creating a particle settling problem. Thus, the coating can be selected from a wider choice of materials to have a refractive index value sufficiently different from the binder's refractive index value to provide the light scattering particles with a high level of light scattering of the incident exposure light, thereby eliminating or minimizing the plywood effect.

The Adhesive Layer

An intermediate layer 5 between the blocking layer and the charge generating layer may, if desired, be provided to promote adhesion. However, in the present invention, a dip coated aluminum drum may be utilized without an adhesive layer.

Additionally, adhesive layers can be provided, if necessary, between any of the layers in the photoreceptors to ensure adhesion of any adjacent layers. Alternatively, or in addition, adhesive material can be incorporated into one or both of the respective layers to be adhered. Such optional adhesive layers preferably have thicknesses of about 0.001 micrometer to about 0.2 micrometer. Such an adhesive layer can be applied, for example, by dissolving adhesive material in an appropriate solvent, applying by hand, spraying, dip coating, draw bar coating, gravure coating, silk screening, air knife coating, vacuum deposition, chemical treatment, roll coating, wire wound rod coating, and the like, and drying to remove the solvent. Suitable adhesives include, for example, film-forming polymers, such as polyester, dupont 49,000 (available from E. I. duPont de Nemours & Co.), Vitel PE-100 (available from Goodyear Tire and Rubber Co.), polyvinyl butyral, polyvinyl pyrrolidone, polyurethane, polymethyl methacrylate, and the like. The adhesive layer may be composed of a polyester with a $M_w$ of from about 50,000 to about 100,000, and preferably about 70,000, and a $M_n$ of preferably about 35,000.

The Imaging Layer(s)

The imaging layer refers to a layer or layers containing charge generating material, charge transport material, or both the charge generating material and the charge transport material.

Either a n-type or a p-type charge generating material can be employed in the present photoreceptor.

The phrase "n-type" refers to materials which predominately transport electrons. Typical n-type materials include dibromoanthanthrone, benzimidazole perylene, zinc oxide, titanium dioxide, azo compounds such as chlorodiane Blue and bisazo pigments, substituted 2,4-dibromotriazines, polynuclear aromatic quinones, zinc sulfide, and the like.

The phrase "p-type" refers to materials which transport holes. Typical p-type organic pigments include, for example, metal-free phthalocyanine, titanyl phthalocyanine, gallium phthalocyanine, hydroxy gallium phthalocyanine, chlorogallium phthalocyanine, copper phthalocyanine, and the like.

Illustrative organic photoconductive charge generating materials include azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments such as benzimidazole perylene; indigo pigments such as indigo, thioindigo, and the like; bisbenzoimidazole pigments such as Indofast Orange, and the like; phthalocyanine pigments such as copper phthalocyanine, aluminochloro-phthalocyanine, hydroxygallium phthalocyanine, and the like; quinacridone pigments; or azulene compounds. Suitable inorganic photoconductive charge generating materials include for example cadium sulfide, cadmium sulfoselenide, cadmium selenide, crystalline and amorphous selenium, lead oxide and other chalcogenides. Alloys of selenium are encompassed by embodiments of the instant invention and include for instance selenium-arsenic, selenium-tellurium-arsenic, and selenium-tellurium.

Any suitable inactive resin binder material may be employed in the charge generating layer. Typical organic resinous binders include polycarbonates, acrylate polymers, methacrylate polymers, vinyl polymers, cellulose polymers, polyesters, polysiloxanes, polyamides, polyurethanes, epoxies, polyvinylacetals, and the like.

To create a dispersion useful as a coating composition, a solvent is used with the charge generating material. The solvent can be for example cyclohexanone, methyl ethyl ketone, tetrahydrofuran, alkyl acetate, and mixtures thereof. The alkyl acetate (such as butyl acetate and amyl acetate) can have from 3 to 5 carbon atoms in the alkyl group. The amount of solvent in the composition ranges for example from about 70% to about 98% by weight, based on the weight of the composition.

The amount of the charge generating material in the composition ranges for example from about 0.5% to about 30% by weight, based on the weight of the composition including a solvent. The amount of photoconductive particles (i.e, the charge generating material) dispersed in a dried photoconductive coating varies to some extent with the specific photoconductive pigment particles selected. For example, when phthalocyanine organic pigments such as titanyl phthalocyanine and metal-free phthalocyanine are utilized, satisfactory results are achieved when the dried photoconductive coating comprises between about 30 percent by weight and about 90 percent by weight of all phthalocyanine pigments based on the total weight of the dried photoconductive coating. Since the photoconductive characteristics are affected by the relative amount of pigment per square centimeter coated, a lower pigment loading may be utilized if the dried photoconductive coating layer is thicker. Conversely, higher pigment loadings are desirable where the dried photoconductive layer is to be thinner.

Generally, satisfactory results are achieved with an average photoconductive particle size of less than about 0.6 micrometer when the photoconductive coating is applied by dip coating. Preferably, the average photoconductive particle size is less than about 0.4 micrometer. Preferably, the photoconductive particle size is also less than the thickness of the dried photoconductive coating in which it is dispersed.

In a charge generating layer, the weight ratio of the charge generating material ("CGM") to the binder ranges from 30 (CGM):70 (binder) to 70 (CGM):30 (binder).

For multilayered photoreceptors comprising a charge generating layer (also referred herein as a photoconductive layer) and a charge transport layer, satisfactory results may be achieved with a dried photoconductive layer coating thickness of between about 0.1 micrometer and about 10 micrometers. Preferably, the photoconductive layer thickness is between about 0.2 micrometer and about 4 micrometers. However, these thicknesses also depend upon the pigment loading. Thus, higher pigment loadings permit the use of thinner photoconductive coatings. Thicknesses outside these ranges can be selected providing the objectives of the present invention are achieved.

Any suitable technique may be utilized to disperse the photoconductive particles in the binder and solvent of the coating composition. Typical dispersion techniques include, for example, ball milling, roll milling, milling in vertical attritors, sand milling, and the like. Typical milling times using a ball roll mill is between about 4 and about 6 days.

Charge transport materials include an organic polymer or non-polymeric material capable of supporting the injection of photoexcited holes or transporting electrons from the photoconductive material and allowing the transport of these holes or electrons through the organic layer to selectively dissipate a surface charge. Illustrative charge transport materials include for example a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and hydrazone compounds. Typical hole transport materials include electron donor materials, such as carbazole; N-ethyl carbazole; N-isopropyl carbazole; N-phenyl carbazole; tetraphenylpyrene; 1-methyl pyrene; perylene; chrysene; anthracene; tetraphene; 2-phenyl naphthalene; azopyrene; 1-ethyl pyrene; acetyl pyrene; 2,3-benzochrysene; 2,4-benzopyrene; 1,4-bromopyrene; poly (N-vinylcarbazole); poly(vinylpyrene); poly(vinyltetraphene); poly(vinyltetracene) and poly (vinylperylene). Suitable electron transport materials include electron acceptors such as 2,4,7-trinitro-9-fluorenone; 2,4,5,7-tetranitro-fluorenone; dinitroanthracene; dinitroacridene; tetracyanopyrene; dinitroanthraquinone; and butylcarbonylfluorenemalononitrile, reference U.S. Pat. No. 4,921,769. Other hole transporting materials include arylamines described in U.S. Pat. No. 4,265,990, such as N,N'-diphenyl-N,N'-bis(alkylphenyl)-(1,1'-biphenyl)-4,4'-diamine wherein alkyl is selected from the group consisting of methyl, ethyl, propyl, butyl, hexyl, and the like. Other known charge transport layer molecules can be selected, reference for example U.S. Pat. Nos. 4,921,773 and 4,464,450.

Any suitable inactive resin binder may be employed in the charge transport layer. Typical inactive resin binders soluble in methylene chloride include polycarbonate resin, polyvinylcarbazole, polyester, polyarylate, polystyrene, polyacrylate, polyether, polysulfone, and the like. Molecular weights can vary from about 20,000 to about 1,500,000.

In a charge transport layer, the weight ratio of the charge transport material ("CTM") to the binder ranges from 30 (CTM):70 (binder) to 70 (CTM):30 (binder).

Any suitable technique may be utilized to apply the charge transport layer and the charge generating layer to the substrate. Typical coating techniques include dip coating, roll coating, spray coating, rotary atomizers, and the like. The coating techniques may use a wide concentration of solids. Preferably, the solids content is between about 2 percent by weight and 30 percent by weight based on the total weight of the dispersion. The expression "solids" refers to the photoconductive pigrnent particles and binder components of the charge generating coating dispersion and to the charge transport particles and binder components of the charge transport coating dispersion. These solids concentrations are useful in dip coating, roll, spray coating, and the like. Generally, a more concentrated coating dispersion is preferred for roll coating. Drying of the deposited coating may be effected by any suitable conventional technique such as oven drying, infra-red radiation drying, air drying and the like. Generally, the thickness of the charge generating layer ranges from about 0.1 micrometer to about 3 micrometers and the thickness of the transport layer is between about 5 micrometers to about 100 micrometers, but thicknesses outside these ranges can also be used. In general, the ratio of the thickness of the charge transport layer to the charge generating layer is preferably maintained from about 2:1 to 200:1 and in some instances as great as 400:1.

The materials and procedures described herein can be used to fabricate a single imaging layer type photoreceptor containing a binder, a charge generating material, and a charge transport material. For example, the solids content in the dispersion for the single imaging layer may range from about 2% to about 30% by weight, based on the weight of the dispersion.

Where the imaging layer is a single layer combining the functions of the charge generating layer and the charge transport layer, illustrative amounts of the components contained therein are as follows: charge generating material (about 5% to about 40% by weight), charge transport material (about 20% to about 60% by weight), and binder (the balance of the imaging layer).

The Overcoating Layer

Embodiments in accordance with the present invention can, optionally, further include an overcoating layer or layers 8, which, if employed, are positioned over the charge generation layer or over the charge transport layer. This layer comprises organic polymers or inorganic polymers that are electrically insulating or slightly semi-conductive.

Such a protective overcoating layer includes a film forming resin binder optionally doped with a charge transport material.

Any suitable film-forming inactive resin binder can be employed in the overcoating layer of the present invention. For example, the film forming binder can be any of a number of resins, such as polycarbonates, polyarylates, polystyrene, polysulfone, polyphenylene sulfide, polyetherimide, polyphenylene vinylene, and polyacrylate. The resin binder used in the overcoating layer can be the same or different from the resin binder used in the anti-curl layer or in any charge transport layer that may be present. The binder resin should preferably have a Young's modulus greater than about $2\times10^5$ psi, a break elongation no less than 10%, and a glass transition temperature greater than about 150 degrees C. The binder may further be a blend of binders. The preferred polymeric film forming binders include MAKROLON™, a polycarbonate resin having a weight average molecular weight of about 50,000 to about 100,000 available from Farbenfabriken Bayer A. G., 4,4'-cyclohexylidene diphenyl polycarbonate, available from Mitsubishi Chemicals, high molecular weight LEXANυ 135, available from the General Electric Company, ARDEL™ polyarylate D-100, available from Union Carbide, and polymer blends of MAKROLON™ and the copolyester VITEL™ PE-100 or VITEL™ PE-200, available from Goodyear Tire and Rubber Co.

In embodiments, a range of about 1% by weight to about 10% by weight of the overcoating layer of VITEL™ copolymer is preferred in blending compositions, and, more preferably, about 3% by weight to about 7% by weight. Other polymers that can be used as resins in the overcoat layer include DUREL™ polyarylate from Celanese, polycarbonate copolymers LEXAN™ 3250, LEXAN™ PPC 4501, and LEXAN™ PPC 4701 from the General Electric Company, and CALIBRE™ from Dow.

Additives may be present in the overcoating layer in the range of about 0.5 to about 40 weight percent of the overcoating layer. Preferred additives include organic and inorganic particles which can further improve the wear resistance and/or provide charge relaxation property. Preferred organic particles include Teflon powder, carbon black, and graphite particles. Preferred inorganic particles include insulating and semiconducting metal oxide particles such as silica, zinc oxide, tin oxide and the like. Another semiconducting additive is the oxidized oligomer salts as described in U.S. Pat. No. 5,853,906. The preferred oligomer salts are oxidized N, N, N', N'-tetra-p-tolyl-4,4'-biphenyldiamine salt.

The overcoating layer can be prepared by any suitable conventional technique and applied by any of a number of application methods. Typical application methods include, for example, hand coating, spray coating, web coating, dip coating and the like. Drying of the deposited coating can be effected by any suitable conventional techniques, such as oven drying, infrared radiation drying, air drying, and the like.

Overcoatings of from about 3 micrometers to about 7 micrometers are effective in preventing charge transport molecule leaching, crystallization, and charge transport layer cracking. Preferably, a layer having a thickness of from about 3 micrometers to about 5 micrometers is employed.

The Ground Strip

Ground strip 9 can comprise a film-forming binder and electrically conductive particles. Cellulose may be used to disperse the conductive particles. Any suitable electrically conductive particles can be used in the electrically conductive ground strip layer 9. The ground strip 9 can, for example, comprise materials that include those enumerated in U.S. Pat. No. 4,664,995. Typical electrically conductive particles include, but are not limited to, carbon black, graphite, copper, silver, gold, nickel, tantalum, chromium, zirconium, vanadium, niobium, indium tin oxide, and the like.

The electrically conductive particles can have any suitable shape. Typical shapes include irregular, granular, spherical, elliptical, cubic, flake, filament, and the like. Preferably, the electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles through the matrix of the dried ground strip layer. Concentration of the conductive particles to be used in the ground strip depends on factors such as the conductivity of the specific conductive materials utilized.

In embodiments, the ground strip layer may have a thickness of from about 7 micrometers to about 42 micrometers and, preferably, from about 14 micrometers to about 27 micrometers.

The invention will now be described in detail with respect to specific preferred embodiments thereof, it being understood that these examples are intended to be illustrative only and the invention is not intended to be limited to the materials, conditions, or process parameters recited herein. All percentages and parts are by weight unless otherwise indicated.

Print Test for Plywood Defect

The photoreceptor imaging samples were evaluated in a 4517 Xerox printer in ambient conditions for plywood print quality. A one-on-two-off print pattern was selected for print output. The resulting prints were then evaluated for the plywood defect. An uniform gray density print-out was an acceptable print quality. A large area non-uniform density, resembling plywood pattern, was not acceptable.

EXAMPLE I

A charge blocking layer was fabricated from a coating dispersion consisting of 80 weight percent of $TiO_2$ and 20 weight percent of phenolic binder composition. The charge blocking layer coating dispersion was prepared by dispersing 40 grams of needle shaped $TiO_2$ particles (STR60N, available from Saikai Chemical Co.) into a solution of 10 grams linear phenolic binder composition, VARCUM® 29112 (available from OxyChem) dissolved in 75 grams of xylene and n-butanol solvent mixture at one to one weight ratio. This dispersion was milled in an attritor (Szegvari attritor system, available from Union Process Co. ) with zirconium balls having a diameter of 0.4 millimeter for 4 hours. The average $TiO_2$ particle size in the dispersion solution was measured to be about 0.12 micrometer. The $TiO_2$ dispersion was then added with 5 gm of silica particles surface coated with $TiO_2$ where the $TiO_2$ surface coating had a thickness believed to be from about 100 angstroms to about 1 micrometer (uncoated silica particles have a number average particle size of about 1 micrometer). The silica particles surface coated with $TiO_2$ were obtained from Espirit Chemical Company. The dispersion was then rolled for 24 hours. The resulting dispersion was then dip coated onto a smooth surface aluminum drum substrate of 30 mm diameter and dried at a temperature of 150 degrees C for 30 minutes to form a blocking layer. The dried blocking layer coating was very uniform and hazy. The dried blocking layer film has a thickness of about 3 micrometers.

A charge generation coating dispersion was prepared by dispersing 22 grams of chloride gallium phthalylene particles having an average particle size of about 0.4 micrometers into a solution of 10 grams VMCH (available from Union Carbide Co.) dissolved in 368 grams of xylene and n-butanol solvent mixture at one to one weight ratio. VMCH was composed of 86% by weight vinyl chloride, 13% by weight vinyl acetate, and 1% by weight maleic acid, where the VMCH has a molecular weight of about 27,000. This dispersion was milled in a dynomill mill (KDL, available from GlenMill) with zirconium balls having a diameter of 0.4 millimeter for 4 hours. The drum with the charge blocking layer coating was dipped in the charge generation coating dispersion and withdrawn at a rate of 20 centimeters per minute. The resulting coated drum was air dried to form a 0.5 micrometer thick charge generating layer.

A charge transport layer coating solution was prepared containing 40 grams of N,N'-diphenyl-N,N'-bis(3-methylphenyl)-(1,1'-biphenyl)-4,4'-diamine and 60 grams of poly(4,4'-diphenyl-1,1'-cyclohexane carbonate) (PCZ 400 available from Mitsubishi Chemical Co.) dissolved in a solvent mixture containing 80 grams of monochlorobenzene and 320 grams of tetrahydrofuran. The charge transport coating solution was applied onto the coated drum by dipping the drum into the charge transport coating solution and withdrawn at a rate of 150 centimeters per second. The coated drum was dried at 110° C. for 20 minutes to form a 20 micrometer thick charge transport layer.

The resulting photoreceptor drum was print tested. The gray prints were uniform without plywood pattern.

Comparayive Example I

The process described in Example I was repeated except that the blocking layer was not doped with silica particles. The blocking layer coating was clear. The resulting photoreceptor was print tested. The gray level prints were non-uniform with clear plywood patterns.

Other modifications of the present invention may occur to those skilled in the art based upon a reading of the present disclosure and these modifications are intended to be included within the scope of the present invention.

We claim:

1. A photoreceptor comprising:

(a) a substrate;

(b) a charge blocking layer including a plurality of light scattering particles dispersed in a binder, wherein the light scattering particles are comprised of a core and a coating over the core, wherein the difference between the coating and the binder refractive index values is greater than the difference between the core and the binder refractive index values; and (c) an imaging layer.

2. The photoreceptor of claim 1, wherein the difference between the core and the binder refractive index values ranges from 0 to about 0.07.

3. The photoreceptor of claim 1, wherein the difference between the core and the binder refractive index values ranges from 0 to about 0.05.

4. The photoreceptor of claim 1, wherein the difference between the coating and the binder refractive index values is at least about 0.08.

5. The photoreceptor of claim 1, wherein the difference between the coating and the binder refractive index values is at least about 1.0.

6. The photoreceptor of claim 1, wherein the difference between the coating and the binder refractive index values ranges from about 0.08 to about 1.5.

7. The photoreceptor of claim 1, wherein the difference between the coating and the binder refractive index values is greater than the difference between the core and the binder refractive index values by at least about 0.05.

8. The photoreceptor of claim 1, wherein the difference between the coating and the binder refractive index values is greater than the difference between the core and the binder refractive index values by at least about 1.0.

9. The photoreceptor of claim 1, wherein the core has a density ranging from about 0.5 to about 2.0 g/cc.

10. The photoreceptor of claim 1, wherein the core has a density ranging from about 1.0 to about 1.5 g/cc.

11. The photoreceptor of claim 1, wherein the coating is a metal oxide.

12. The photoreceptor of claim 1, wherein the coating is a metal oxide selected from the group consisting of titanium dioxide and zinc oxide.

13. The photoreceptor of claim 1, wherein the image layer is a charge generating layer and the photoreceptor further comprises a charge transport layer.

14. A photoreceptor comprising:

(a) a substrate;

(b) a charge blocking layer including a plurality of light scattering particles dispersed in a binder, wherein the light scattering particles are comprised of a core and a coating over the core, wherein the difference between the coating and the binder refractive index values is greater than the difference between the core and the binder refractive index values, wherein the core is selected from the group consisting of inorganic materials except for metal containing compounds and organic materials; and (c) an imaging layer.

15. The photoreceptor of claim 14, wherein the organic materials are polymeric materials.

16. The photoreceptor of claim 14, wherein the inorganic materials are silica.

* * * * *